US005992144A

United States Patent [19]

Takanohashi et al.

[11] Patent Number: 5,992,144

[45] Date of Patent: Nov. 30, 1999

[54] AIR-FUEL RATIO CONTROL SYSTEM FOR INTERNAL COMBUSTION ENGINES

[75] Inventors: Toshikatsu Takanohashi; Hiroshi Ohno, both of Wako, Japan

[73] Assignee: Honda Giken Kogyo Kabushiki Kaisha, Tokyo, Japan

[21] Appl. No.: 09/050,024

[22] Filed: Mar. 30, 1998

[30] Foreign Application Priority Data

Apr. 17, 1997 [JP] Japan ..... 9-114240

[51] Int. Cl.[6] ..... F01N 3/00

[52] U.S. Cl. ..... 60/286; 60/285; 60/276

[58] Field of Search ..... 60/286, 285, 276

[56] References Cited

U.S. PATENT DOCUMENTS

| | | | |
|---|---|---|---|
| 5,388,403 | 2/1995 | Nagami et al. | 60/276 |
| 5,412,945 | 5/1995 | Katoh et al. | 60/285 |
| 5,423,181 | 6/1995 | Katoh et al. | 60/276 |
| 5,433,074 | 7/1995 | Seto et al. | 60/301 |

FOREIGN PATENT DOCUMENTS

| | | |
|---|---|---|
| 560 991 A1 | 9/1993 | European Pat. Off. . |
| 562 805 A1 | 9/1993 | European Pat. Off. . |
| 585 900 A1 | 3/1994 | European Pat. Off. . |
| 6-294319 | 10/1994 | Japan . |
| 7-54695 | 2/1995 | Japan . |

*Primary Examiner*—Thomas E. Denion
*Assistant Examiner*—Binh Tran
*Attorney, Agent, or Firm*—Nikaido Marmelstein Murray & Oram LLP

[57] ABSTRACT

An air-fuel ratio control system controls the air-fuel ratio of a mixture supplied to an internal combustion engine. An exhaust gas purifying-device arranged in the exhaust system of the engine accommodates a nitrogen oxide absorbent for absorbing nitrogen oxides in exhaust gases emitted from the engine. Nitrogen oxides absorbed by the nitrogen oxide absorbent is reduced by enriching the air-fuel ratio of the mixture supplied to the engine. The degree of the enriching of the air-fuel ratio is set to a larger value as a flow rate or flow velocity of the exhaust gases increases.

8 Claims, 6 Drawing Sheets

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system for an international combustion engine which has an exhaust gas-purifying device with an absorbent for absorbing nitrogen oxides, arranged in the exhaust system.

2. Prior Art

When an internal combustion engine operates in a condition where the air-fuel ratio of a mixture supplied to the engine is set to a leaner value than a stoichiometric air-fuel ratio to carry out so-called lean-burn control, it is likely that an increased amount of nitrogen oxides (hereinafter referred to as "NOx") is emitted from the engine. To overcome this disadvantage, it is conventionally employed to provide an exhaust gas-purifying device accommodating a NOx absorbent for absorbing NOx arranged in the exhaust system of the engine, to thereby carry out purification of exhaust gases emitted from the engine. The NOx absorbent has such a characteristic that it absorbs NOx when the air-fuel ratio is leaner than the stoichiometric air-fuel ratio and accordingly the concentration of oxygen present in exhaust gases is relatively high, i.e. the amount of NOx is large (hereinafter referred to as "the exhaust gas lean state"), whereas it desorbs the absorbed NOx when the air-fuel ratio is richer than the stoichiometric air-fuel ratio and accordingly the concentration of oxygen present in exhaust gases is low, i.e. the amount of HC and CO is large (hereinafter referred to as "the exhaust gas rich state"). Therefore, in the exhaust gas rich state, the exhaust gas-purifying device with the NOx absorbent functions to reduce NOx desorbed from the NOx absorbent to a nitrogen gas by reaction with HC and CO, which is emitted into the air, and oxidize HC and CO into steam and carbon dioxide, which are also emitted into the air.

The NOx absorbent, however, has a limited capacity for absorbing NOx, and therefore the lean-burn control cannot be continued over a long time period. To cope with this inconvenience, there is conventionally known an air-fuel ratio control method, for example, from Japanese Laid-Open Patent Publication (Kokai) No. 6-294319, which temporarily enriches the air-fuel ratio in order to desorb NOx which has been absorbed by the NOx absorbent, for reduction of the thus desorbed NOx. In the present specification, this temporary enrichment of the air-fuel ratio for desorbing NOx will be referred to as "reduction enrichment".

According to this air-fuel ratio control method, the degree of reduction enrichment is set to a larger value as the amount of exhaust gases emitted per unit time is smaller. In other words, the degree of reduction enrichment is set to a smaller value as the amount of exhaust gases is larger. This setting is based on the ground that when the amount of exhaust gases emitted per unit time is smaller and accordingly the amount of HC and CO present in the exhaust gases is smaller, NOx desorbed from the NOx absorbent cannot be reduced to a sufficient degree if the degree of reduction enrichment or enrichment of a mixture supplied to the engine is constant.

Further, there is conventionally known a control method, for example, from Japanese Laid-Open Patent Publication (Kokai) No. 7-54695, which, in changing the air-fuel ratio of a mixture supplied to an internal combustion engine with a three-way catalyst arranged in the exhaust system, from a stoichiometric air-fuel ratio to a leaner value, temporarily sets the air-fuel ratio to a richer value than the stoichiometric air-fuel ratio and then changes the air-fuel ratio to a leaner value, to thereby reduce the emission amount of NOx immediately after the change of the air-fuel ratio to the leaner value. According to this method, by temporarily enriching the air-fuel ratio, oxygen stored in the three-way catalyst is released to enhance the oxygen storage capacity of the three-way catalyst, to thereby reduce the emission amount of NOx immediately after the change of the air-fuel ratio to a leaner value.

The method according to Japanese Laid-Open Patent Publication (Kokai) No. 6-294319, however, has the following inconvenience: That is, when a large amount of exhaust gases per unit time is emitted from the engine, the temperature of the NOx absorbent rises, which leads to an increase in the amount of NOx desorbed from the NOx absorbent. If the degree of enrichment is then set to a smaller value, NOx cannot be reduced to a sufficient degree. Further, a larger amount of exhaust gases emitted per unit time, i.e. a larger exhaust gas flow rate (volume/time) means a higher exhaust gas flow velocity (volume/(time×cross sectional area)), which results in insufficient contact between HC and CO and the NOx absorbent (catalyst). This also leads to insufficient reduction of NOx. As a result, the emission amount of NOx unfavorably increases as the exhaust gas flow rate increases.

Further, if the method according to Japanese Laid-Open Patent Publication (Kokai) No. 7-54695 is applied to the air-fuel ratio control of an internal combustion engine provided with the exhaust gas-purifying device accommodating the NOx absorbent, to change the air-fuel ratio from a stoichiometric value to a leaner value, a similar inconvenience to that mentioned above can occur. That is, when the reduction enrichment is first carried out and then the air-fuel ratio is controlled to a leaner value, if the degree of reduction enrichment is made constant irrespective of the exhaust gas flow rate or the degree of reduction enrichment is made smaller as the exhaust gas flow rate increases, the emission amount of NOx unfavorably increases.

SUMMARY OF THE INVENTION

It is the object of the invention to provide an air-fuel ratio control system for an internal combustion engine with an exhaust gas-purifying device accommodating a NOx absorbent, which is capable of carrying out air-fuel ratio control of the engine in such a manner as to suppress an increase in the emission amount of NOx over a wide range of operating condition of the engine, to thereby maintain good exhaust emission characteristics.

To attain the above object, the present invention provides an air-fuel ratio control system for controlling an air-fuel ratio of a mixture supplied to an internal combustion engine having an exhaust system, comprising:

an exhaust gas purifying-device arranged in the exhaust system and accommodating a nitrogen oxide absorbent for absorbing nitrogen oxides in exhaust gases emitted from the engine; and reduction means for reducing nitrogen oxides absorbed by the nitrogen oxide absorbent by enriching the air-fuel ratio of the mixture supplied to the engine;

wherein the reduction means sets a degree of the enriching of the air-fuel ratio of the mixture to a larger value as a flow rate or flow velocity of the exhaust gases increases.

Preferably, the reduction means sets a desired air-fuel ratio to which the air-fuel ratio of the mixture is to be enriched by the enriching to a richer value as at least one of rotational speed of the engine and load on the engine is higher.

Also preferably, the reduction means sets a time period over which the enriching is to continue to a longer value as at least one of rotational speed of the engine and load on the engine is higher.

Preferably, the reduction means is operable when air-fuel ratio leaning control of leaning the air-fuel ratio of the mixture to a leaner value than a stoichiometric air-fuel ratio has continued over a predetermined time period.

More preferably, the predetermined time period is set depending on operating conditions of the engine.

Further preferably, the predetermined time period is set to a shorter value as at least one of rotational speed of the engine or load on the engine is higher.

Advantageously, the reduction means is operable immediately when the engine has shifted from an operating condition in which the air-fuel ratio of the mixture is controlled to a value equal to or richer than a stoichiometric air-fuel ratio to an operating condition in which the air-fuel ratio of the mixture is controlled to a value leaner than the stoichiometric air-fuel ratio.

The above and other objects, features, and advantages of the invention will become more apparent from the following detailed description taken in conjunction with the accompanying drawings.

BRIEF DESCRIPTION OF THE DRAWINGS

FIGS. 6A to 6C collectively form a timing chart showing the relationship between parameters for use in carrying out the reduction enrichment, in which:

FIG. 6A shows a change in a final desired air-fuel ratio coefficient KCMDM;

FIG. 6B shows a change in the count value of a timer tmRR; and

FIG. 6C shows a change in the count value of a counter CTRR.

DETAILED DESCRIPTION

The invention will now be described in detail with reference to the drawings showing an embodiment thereof.

Figure 1:
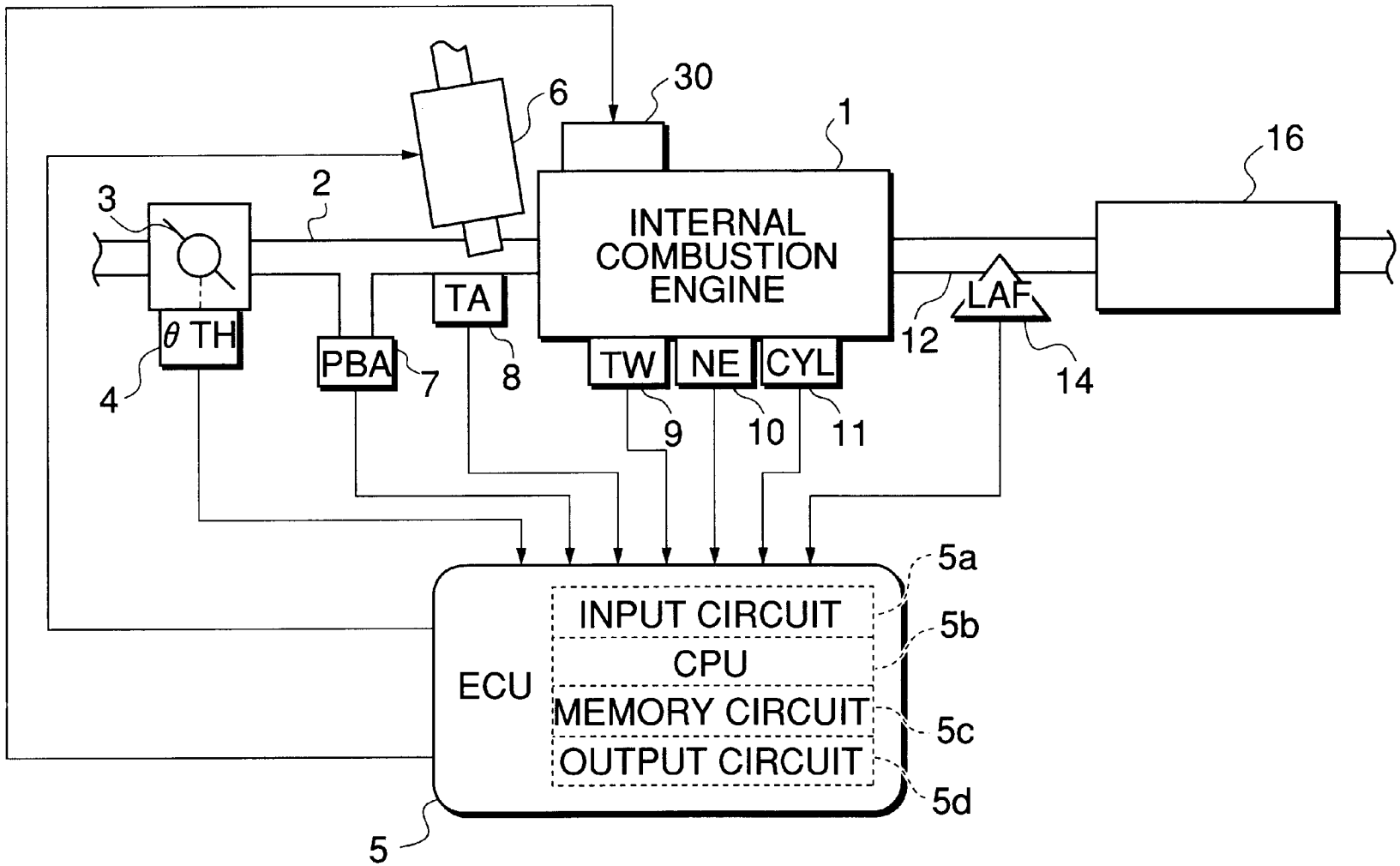
FIG. 1 is a block diagram schematically showing the whole arrangement of an internal combustion engine and an air-fuel ratio control system therefor, according to an embodiment of the invention.

Referring first to FIG. 1, there is schematically illustrated the whole arrangement of an internal combustion engine and an air-fuel ratio control system therefor, according to an embodiment of the invention. In the figure, reference numeral 1 designates an internal combustion engine (hereinafter simply referred to as "the engine") having four cylinders, for instance. Connected to the cylinder block of the engine 1 is an intake pipe 2 in which is arranged a throttle valve 3. A throttle valve opening (θTH) sensor 4 is connected to the throttle valve 3, for generating an electric signal indicative of the sensed throttle valve opening θTH and supplying the same to an electronic control unit (hereinafter referred to as "the ECU") 5 for controlling the engine.

Fuel injection valves 6, only one of which is shown, are each provided for each cylinder and arranged in the intake pipe 2 at a location intermediate between the engine 1 and the throttle valve 3 and slightly upstream of an intake valve, not shown. The fuel injection valves 6 are connected to a fuel pump, not shown, and electrically connected to the ECU 5 to have their valve opening periods controlled by signals therefrom.

Further, an intake pipe absolute pressure (PBA) sensor 7 is provided in communication with the interior of the intake pipe 2, at a location immediately downstream of the throttle valve 3, for supplying an electric signal indicative of the sensed absolute pressure PBA within the intake pipe 2 to the ECU 5. An intake air temperature (TA) sensor 8 is inserted into the interior of the intake pipe 2 at a location downstream of the PBA sensor 7, for supplying an electric signal indicative of the sensed intake air temperature TA to the ECU 5.

An engine coolant temperature (TW) sensor 9 formed of a thermistor or the like is mounted in the cylinder block, for supplying an electric signal indicative of the sensed engine coolant temperature TW to the ECU 5.

An engine rotational speed (NE) sensor 10 and a cylinder-discriminating (CYL) sensor 11 are arranged in facing relation to a camshaft or a crankshaft of the engine 1, neither of which is shown. The NE sensor 10 generates a TDC signal pulse at each of predetermined crank angles (e.g. whenever the crankshaft rotates through 180 degrees when the engine is of the 4-cylinder type) which each correspond to a predetermined crank angle before a top dead point (TDC) of each cylinder corresponding to the start of the suction stroke of the cylinder. The CYL sensor 11 generates a signal pulse at a predetermined crank angle of a particular cylinder of the engine 1, these signal pulses being supplied to the ECU 5.

An exhaust gas-purifying device 16 is arranged in an exhaust pipe 12 connected to the cylinder block of the engine 1, for purifying exhaust gases emitted from the engine. The exhaust gas-purifying device 16 accommodates a NOx absorbent for absorbing nitrogen oxides (NOx) and a catalyst for performing oxidation and reduction of HC, CO, and NOx. The NOx absorbent has such a characteristic that it absorbs NOx when the air-fuel ratio of a mixture supplied to the engine 1 is leaner than a stoichiometric air-fuel ratio and accordingly the concentration of oxygen present in exhaust gases is relatively high, i.e. the amount of NOx is large (in the exhaust gas lean state), whereas it desorbs absorbed NOx when the air-fuel ratio is richer than the stoichiometric air-fuel ratio and accordingly the concentration of oxygen present in exhaust gases is low, i.e. the amount of HC and CO is large (in the exhaust gas rich state). The exhaust gas-purifying device 16 functions in the exhaust gas lean state to absorb NOx into the NOx absorbent. On the other hand, the exhaust gas-purifying device 16 functions in the exhaust gas rich state to reduce NOx desorbed from the NOx absorbent to a nitrogen gas by reaction with HC and CO, which is emitted into the air, and oxidize HC and CO into steam and CO2, which are also emitted into the air. The NOx absorbent is formed, e.g. of barium oxide (BaO), and the catalyst is formed, e.g. of platinum (Pt). The NOx absorbent has such a characteristic that it more easily desorbs the absorbed NOx as the temperature thereof rises. The NOx absorbent desorbs NOx if the oxygen concentration lowers so that the generation amount of NOx decreases even in the exhaust gas lean state.

As described before, however, once the NOx absorbent absorbs NOx to the full extent of its capacity, the absorbent can no more absorb NOx. Therefore, to cause desorbing of NOx for reduction thereof, reduction enrichment of the air-fuel ratio is carried out. In this reduction enrichment, if the degree of enrichment is too small, the desorbed NOx is only reduced to an insufficient degree, whereas if the degree of enrichment is too large, HC and CO are emitted in large amounts. Therefore, the degree of enrichment must be controlled in a manner suitable for operating conditions of the engine so as to maintain good exhaust emission characteristics.

A linear output air-fuel ratio sensor (hereinafter referred to as "the LAF sensor") 14 is arranged in the exhaust pipe 12 at a location upstream of the exhaust gas-purifying device 16, for generating an electric signal almost proportional in value to the concentration of oxygen (air-fuel ratio) present in exhaust gases emitted from the engine and supplying the same to the ECU 5.

The engine 1 includes a valve timing changeover mechanism 30 which changes valve timing of intake valves and exhaust valves, neither of which is shown, between a high speed valve timing suitable for operation of the engine in a high speed operating region and a low speed valve timing suitable for operation of the engine in a low speed operating region. The changeover of the valve timing includes changeover of the valve lift amount, and further, when the low speed valve timing is selected, one of the two intake valves is disabled, thereby ensuring stable combustion even when the air-fuel ratio of the mixture is controlled to a leaner value than a stoichiometric air-fuel ratio.

The valve timing changeover mechanism 30 changes the valve timing by means of hydraulic pressure, and an electromagnetic valve for changing the hydraulic pressure and a hydraulic pressure sensor, neither of which is shown, are electrically connected to the ECU 5. A signal indicative of the sensed hydraulic pressure is supplied to the ECU 5 which in turn controls the electromagnetic valve to change the valve timing according to operating conditions of the engine.

The ECU 5 is comprised of an input circuit 5*a* having the functions of shaping the waveforms of input signals from various sensors including ones mentioned above, shifting the voltage levels of sensor output signals to a predetermined level, converting analog signals from analog-output sensors to digital signals, and so forth, a central processing unit (hereinafter referred to as the "the CPU") 5*b*, a memory circuit 5*c* storing various operational programs which are executed by the CPU 5*b*, and for storing results of calculations therefrom, etc., and an output circuit 5*d* which outputs driving signals to the fuel injection valves 6, etc.

The CPU 5*b* operates in response to the above-mentioned various engine parameter signals from the various sensors to determine operating conditions in which the engine 1 is operating, such as an air-fuel ratio feedback control region where the air-fuel ratio is controlled in response to the oxygen concentration in exhaust gases, and open-loop control regions other than the air-fuel ratio feedback control region, and calculates, based upon the determined engine operating conditions, a fuel injection period TOUT over which each fuel injection valve 6 is to be opened by the use of the following equation (1), in synchronism with generation of TDC signal pulses:

$$TOUT=TI\times KCMDM\times KLAF\times K1+K2 \quad (1)$$

where TI represents a basic value of the fuel injection period TOUT of the fuel injection valve 6, which is determined according to the engine rotational speed NE and the intake pipe absolute pressure PBA.

KCMDM represents a final desired air-fuel ratio coefficient which is obtained by effecting a fuel cooling-dependent correction on a desired air-fuel ratio coefficient KCMD which is determined according to engine operating parameters, such as the engine rotational speed NE, the intake pipe absolute pressure PBA, and the engine coolant temperature TW, as described hereinafter. The KCMD value is proportional to the reciprocal of the air-fuel ratio A/F, i.e. the fuel-air ratio F/A, and set to 1.0 when the air-fuel ratio assumes the stoichiometric value. Therefore, the KCMD value will be also referred to as the desired equivalent ratio.

KLAF represents an air-fuel ratio correction coefficient which is calculated through PID control such that a detected equivalent ratio KACT determined in response to an output from the LAF sensor 14 becomes equal to the desired equivalent ratio KCMD.

K1 and K2 represent other correction coefficients and correction variables, respectively, which are set according to engine operating parameters to such values as optimize operating characteristics of the engine, such as fuel consumption and engine accelerability.

The CPU 5*b* supplies driving signals to the fuel injection valves 6 via the output circuit 5*d*, to open the same over the fuel injection period TOUT obtained by the above calculation.

Figure 2:
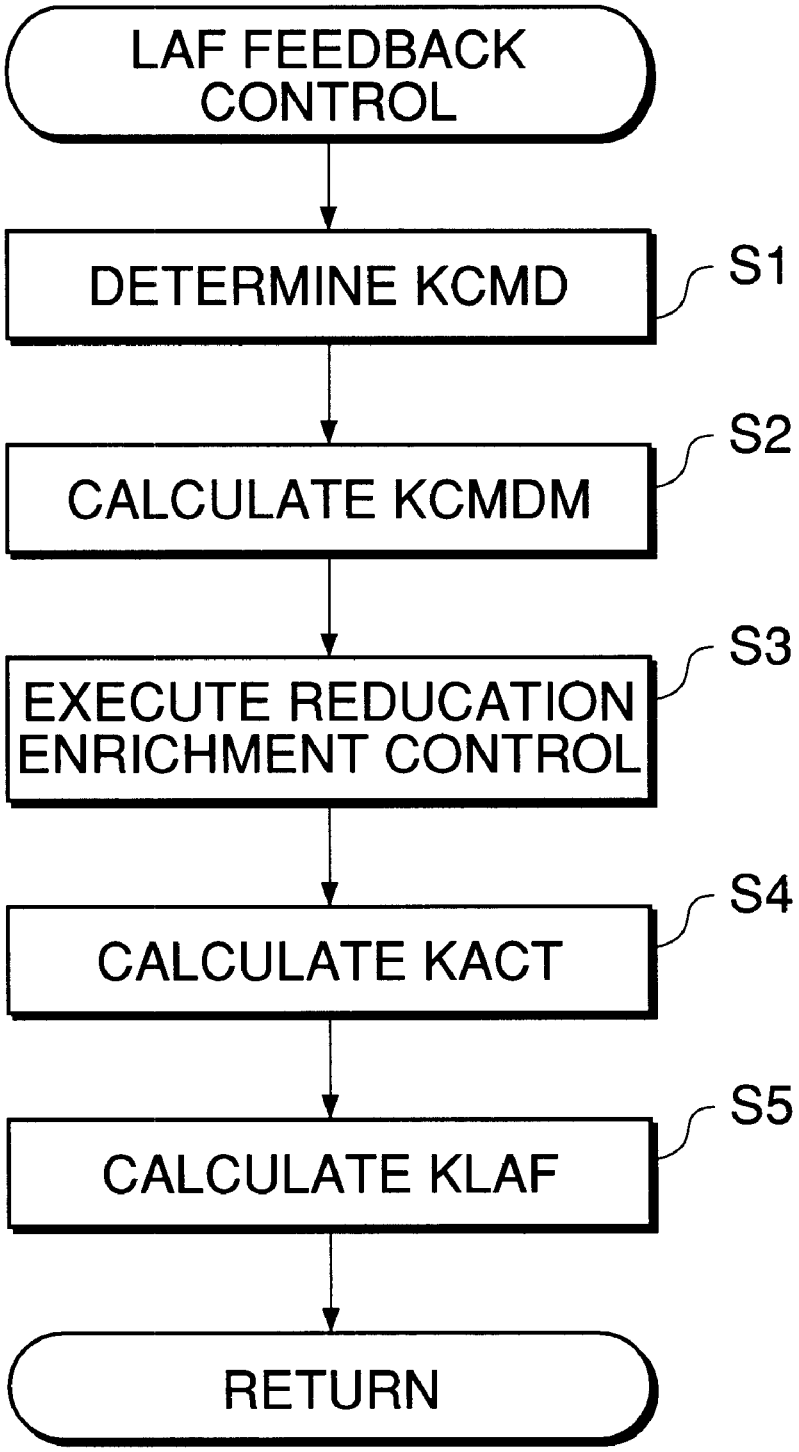
FIG. 2 is a flowchart showing a main routine for carrying out air-fuel ratio feedback control in response to an output from an air-fuel ratio sensor appearing in FIG. 1.

FIG. 2 shows a main routine for calculating the air-fuel ratio correction coefficient KLAF by determining the desired equivalent ratio KCMD and by carrying out the PID control such that the detected equivalent ratio KACT becomes equal to the desired equivalent ratio KCMD. This routine is executed in synchronism with generation of, e.g. TDC signal pulses.

First, at a step S1, the desired equivalent ratio KCMD is determined. The KCMD value is basically determined according to the engine rotational speed NE and the intake pipe absolute pressure PBA, and when the engine 1 is in a condition of low engine coolant temperature TW or in a predetermined high load condition, the KCMD value is set to a value according to the condition.

At a step S2, the fuel cooling-dependent correction is effected on the desired equivalent ratio KCMD, to thereby calculate the final desired air-fuel ratio coefficient KCMDM, by the use of the following equation (2):

$$KCMDM=KCMD\times KETC \quad (2)$$

where KETC represents a fuel cooling-dependent correction coefficient which is set to a larger value as the KCMD value increases. The fuel cooling-dependent correction is carried out in view of the fact that the fuel cooling effect due to fuel injection becomes larger as the KCMD value increases and hence the fuel injection amount increases.

Figure 3:
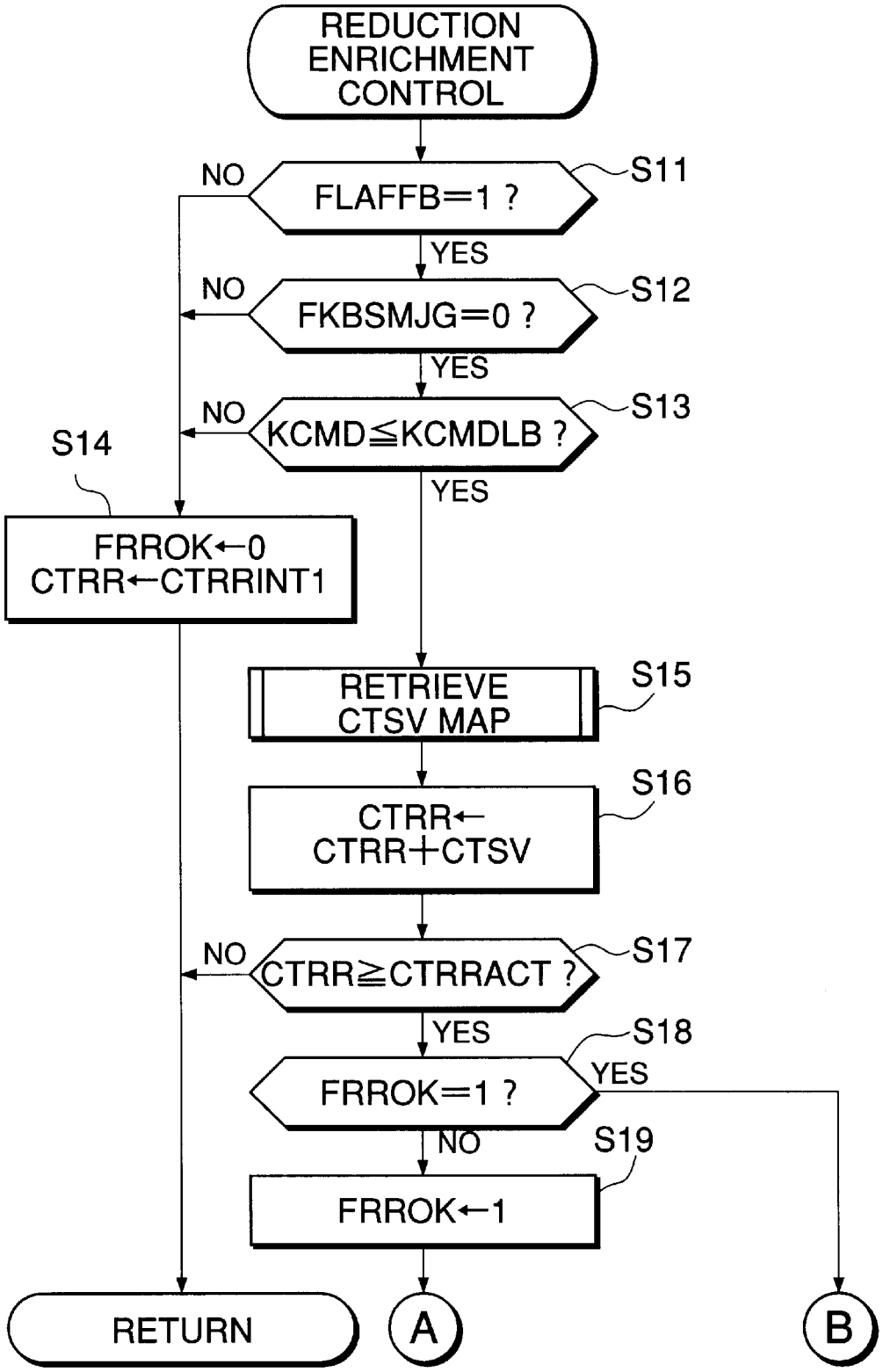
FIG. 3 is a flowchart showing a subroutine for carrying out reduction enrichment, which is executed at a step S3 in FIG. 2.
Figure 4:
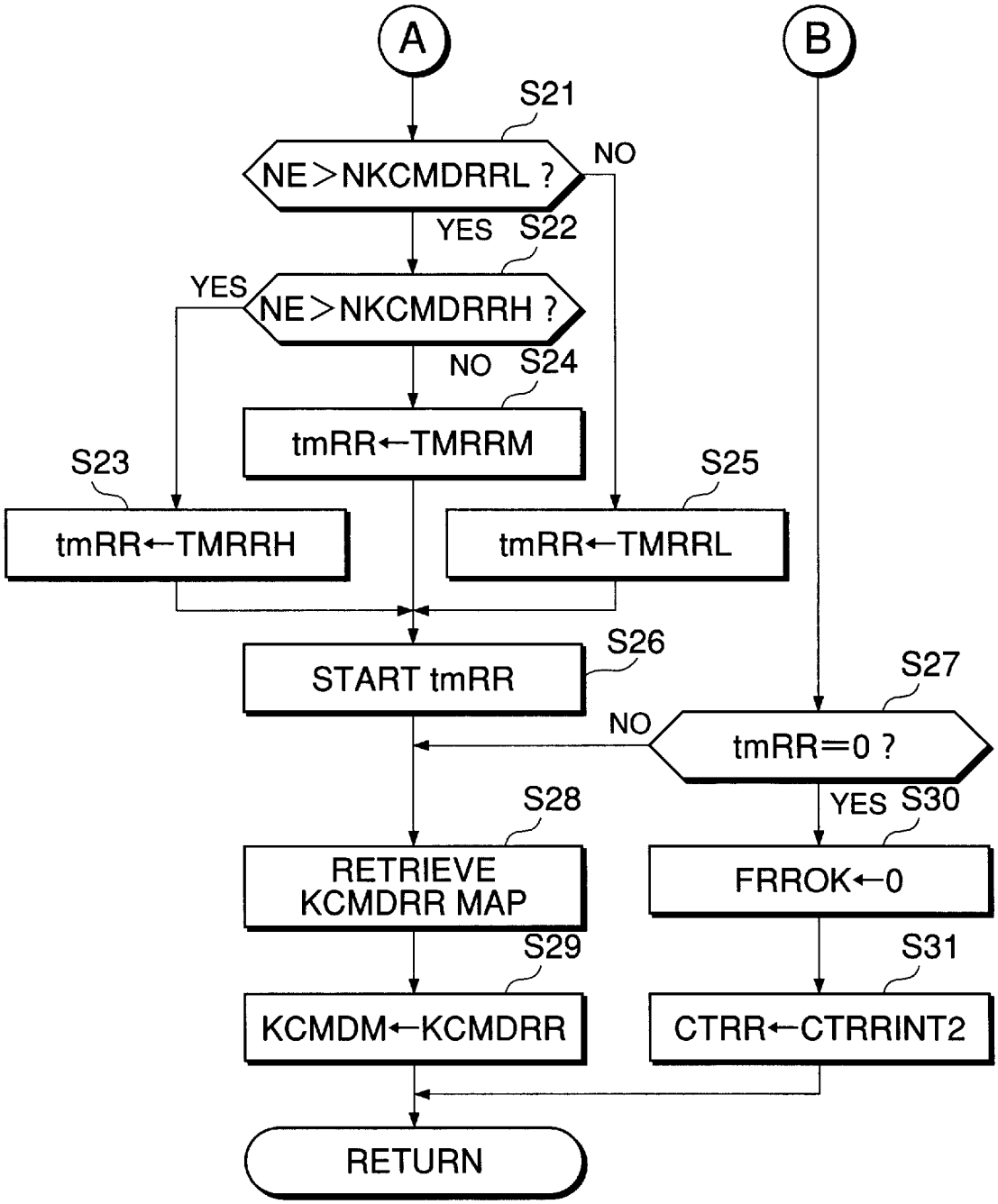
FIG. 4 is a continued part of the flowchart of FIG. 3.

At a step S3, a reduction enrichment control process of FIGS. 3 and 4 is carried out, and at a step S4, the output from the LAF sensor 14 is converted into the equivalent ratio, to calculate the detected equivalent ratio KACT. At the following step S5, the PID control is carried out based on the difference between the detected equivalent ratio KACT and the desired equivalent ratio KCMD, to calculate the air-fuel ratio correction coefficient KLAF such that the detected equivalent ratio KACT becomes equal to the desired equivalent ratio KCMD.

FIGS. 3 and 4 show a subroutine for carrying out the reduction enrichment control process executed at the step S3 in FIG. 2.

First, at a step S11, it is determined whether or not a feedback control flag FLAFFB is equal to "1". The flag FLAFFB, when set to "1", indicates that the engine 1 is in the air-fuel ratio feedback control region in which the air-fuel ratio feedback control is to be carried out in response to the output from the LAF sensor 14. If FLAFFB=1 holds, which means that the engine is in the feedback control region, it is determined at a step S12 whether or not a lean-burn control flag FKBSMJG is equal to "0". The FKBSMJG flag, when set to "0", indicates that the engine 1 is in a lean-burn control region in which the air-fuel ratio is set to a value leaner than the stoichiometric value. If FKBSMJG=0 holds, which means that the engine 1 is in the lean-burn control region, it is determined at a step S13 whether or not the desired equivalent ratio KCMD is equal to or smaller than a predetermined equivalent ratio KCMDLB (e.g. 0.98) which is set to a slightly leaner value than the stoichiometric value.

If any of the answers to the questions of the steps S11 to S13 is negative (NO), a reduction enrichment flag FRROK which, when set to "1", indicates that the reduction enrichment is being carried out is set to "0", and at the same time a counter CTRR is set to a first predetermined value CTRRINT1 (referred to hereinafter with reference to FIG. 6C) at a step S14, followed by terminating the present routine without carrying out the reduction enrichment.

Figure 5A:
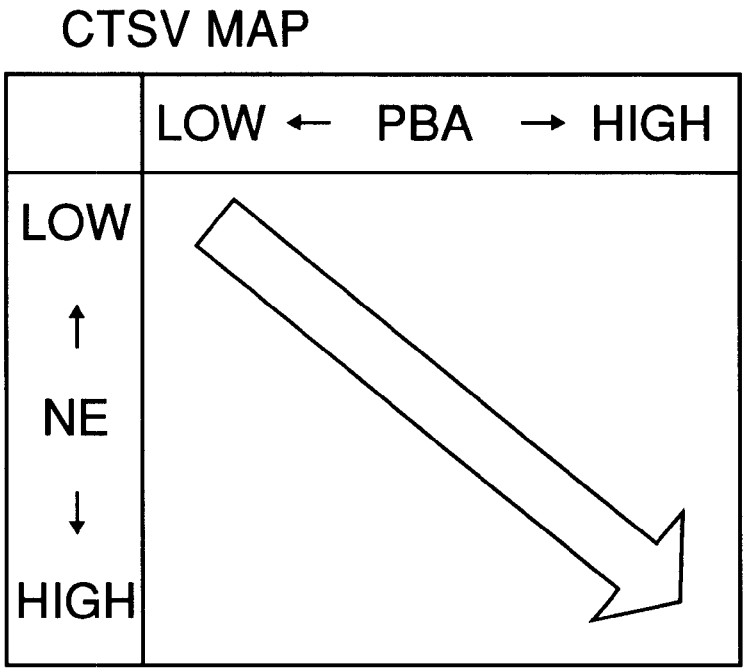
FIG. 5A shows a CTSV map used in the FIG. 3 routine.

On the other hand, if the answers to the questions of the steps S11 to S13 are all affirmative (YES), which means that conditions for carrying out the lean-burn control are satisfied, the program proceeds to a step S15, wherein a CTSV map shown in FIG. 5A is retrieved, to determine an increment CTSV of the count value of the counter CTRR. The CTSV map is set such that the increment CTSV is determined according to the engine rotational speed NE and the intake pipe absolute pressure PBA. More specifically, the increment CTSV is set to a larger value as the engine rotational speed NE increases and/or the intake pipe absolute pressure PBA increases.

At the following step S16, the count value of the counter CTRR is incremented by the value CTSV, and then it is determined at a step S17 whether or not the thus incremented value of the counter CTRR is equal to or larger than a predetermined threshold value CTRRACT (referred to hereinafter with reference to FIG. 6C) which is smaller than the first predetermined value CTRRINT1. Immediately after the conditions for carrying out the lean-burn control become satisfied, the counter CTRR is set to the first predetermined value CTRRINT1 (see the step S14), and accordingly CTRR≧CTRRACT holds, and then the program proceeds to a step S18.

At the step S18, it is determined whether or not the reduction enrichment flag FRROK is equal to "1". When this question is first made, FRROK=0 holds, and therefore the flag FRROK is set to "1" at a step S19. Then, it is determined at a step S21 whether or not the engine rotational speed NE is higher than a first predetermined value NKCMDRRL (e.g. 1000 rpm). If NE>NKCMDRRL holds, it is determined at a step S22 whether or not the engine rotational speed NE is higher than a second predetermined value NKCMDRRH (e.g. 2000 rpm) which is higher than the first predetermined value NKCMDRRL. If NE≦KCMDRRL holds, which means that the engine is in a low rotational speed region, a down-counting timer tmRR is set to a predetermined value TMRRL (e.g. 300 msec) suitable for the low rotational speed region at a step S25, followed by the program proceeding to a step S26. If NKCMDRRL<NE≦NKCMDRRH holds, which means that the engine is in an intermediate rotational speed region, the timer tmRR is set to a predetermined value TMRRM (e.g. 500 msec) suitable for the intermediate rotational speed region and longer than the value TMRRL at a step S24, followed by the program proceeding to the step S26. On the other hand, if NE>NKCMDRRH holds, which means that the engine is in a high rotational speed region, the timer tmRR is set to a predetermined value TMRRH (e.g. 800 msec) suitable for the high rotational speed region and longer than the value TMRRM at a step S23, followed by the program proceeding to the step S26. In the present embodiment, the count value of the timer tmRR is set to a longer value as the NE value increases, but this is not limitative. Alternatively, the count value of the timer tmRR may be set to a longer value depending on an increase in the intake pipe absolute pressure PBA in place of, or in addition to the NE value.

Figure 5B:
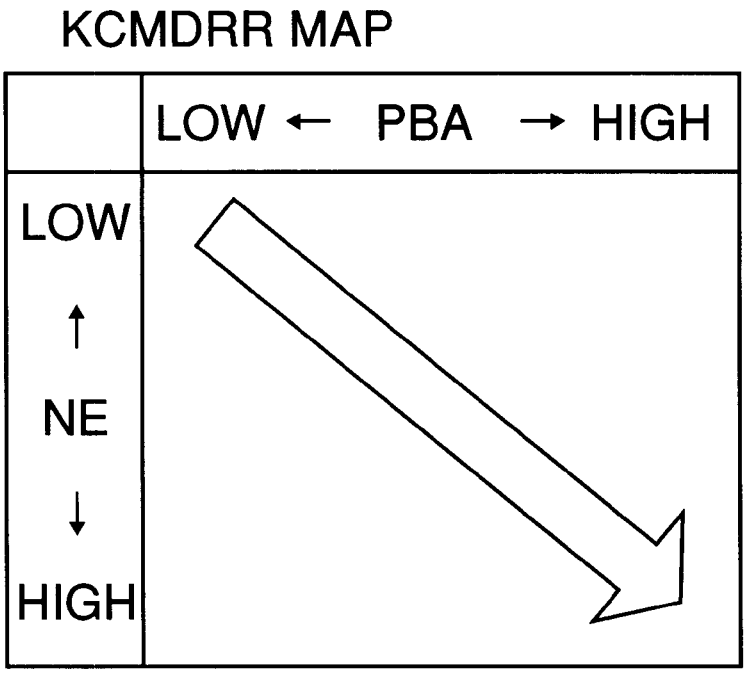
FIG. 5B shows a KCMDRR map used in the FIG. 4 routine.
Figures 6A, 6B, 6C:
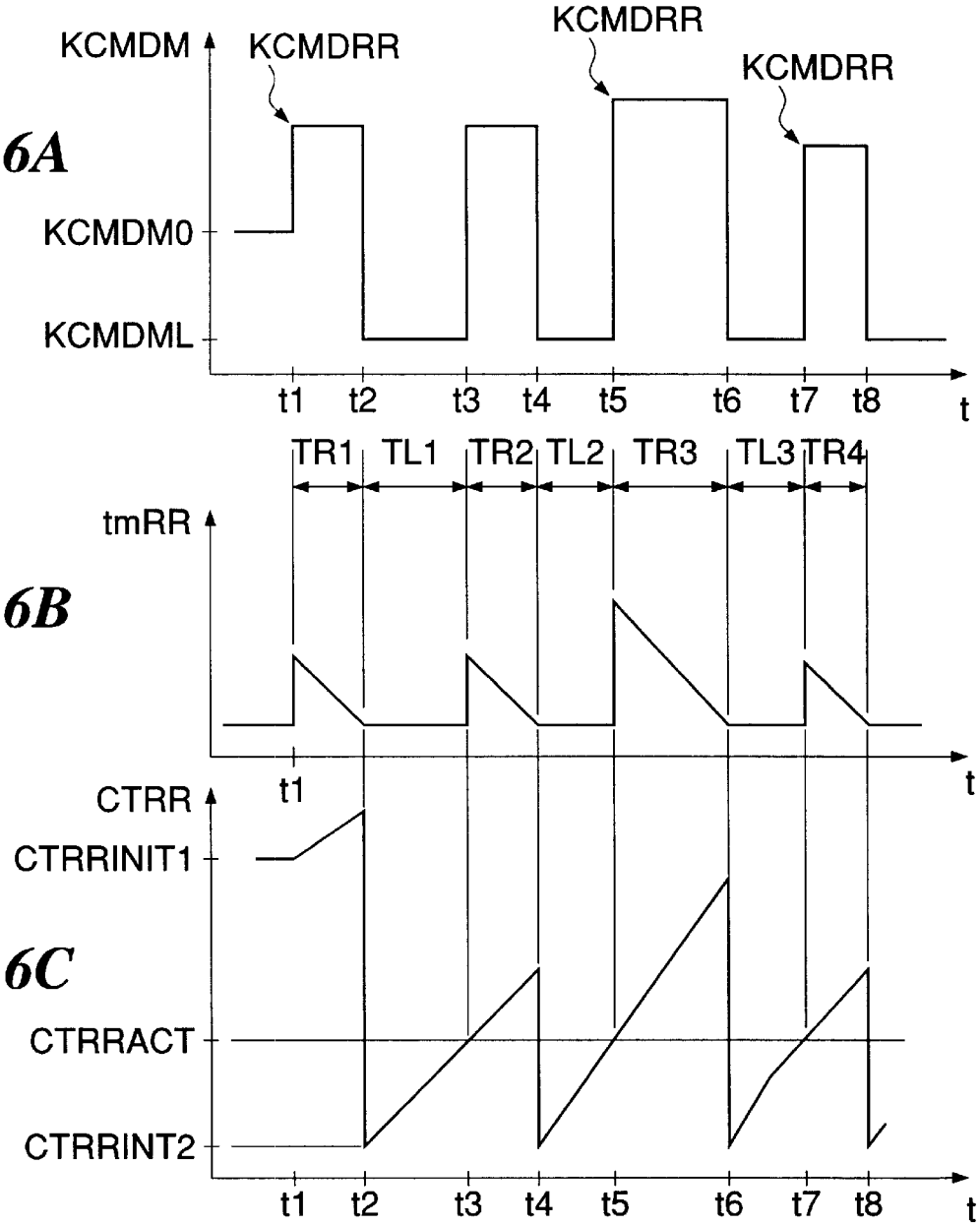

At the step S26, the timer tmRR which has been set at the step S23, S24 or S25 is started (see FIG. 6B, a time point t1). Then, a KCMDRR map of FIG. 5B is retrieved to determine a reduction enrichment desired equivalent ratio KCMDRR at a step S28, and the final desired air-fuel ratio coefficient KCMDM is set to the reduction enrichment desired equivalent ratio KCMDRR at a step S29, followed by terminating the present routine.

The KCMDRR map is set such that the reduction enrichment desired equivalent ratio KCMDRR is determined according to the engine rotational speed NE and the intake pipe absolute pressure PBA. More specifically, the KCMDRR value is set to a larger value as the engine rotational speed NE increases and/or the intake pipe absolute pressure PBA increases. All the map values of the KCMDRR value are set to larger values than 1.0.

If the reduction enrichment flag FRROK is set to "1" to start the reduction enrichment at the step S19, in the following loop of execution of this routine, the answer to the question of the step S18 becomes affirmative (YES), and therefore the program proceeds to a step S27, wherein it is determined whether or not the count value of the timer tmRR is equal to "0". When this question is first made, tmRR>0 holds, and therefore the program proceeds to the step S28. On the other hand, if tmRR=0 holds at the step S27 (see a time point t2 in FIG. 6), the reduction enrichment flag FRROK is set to "0" at a step S30, and the count value of the counter CTRR is set to a second predetermined value CTRRINT2 (e.g. 0) which is smaller than the predetermined threshold value CTRRACT at a step S31, followed by terminating the reduction enrichment. When the steps S30 and S31 are executed, the final desired air-fuel ratio coefficient KCMDM is held at the value calculated at the step S2 in FIG. 2, and therefore the lean-burn control is started.

Thereafter, the steps S16 and S17 are repeatedly executed, i.e. the lean-burn control is carried out, and when the count value of the counter CTRR reaches the predetermined threshold value CTRRACT (a time point t3 in FIG. 6), the program proceeds to the step S18 et seq. to carry out the reduction enrichment.

FIGS. 6A to 6C collectively form a timing chart useful in explaining the process of FIGS. 3 and 4, wherein FIG. 6A shows a change in the final desired air-fuel ratio coefficient KCMDM, FIG. 6B a change in the count value of the timer tmRR, and FIG. 6C a change in the count value of the counter CTRR. KCMDM0 in FIG. 6A represents a value (1.0) corresponding to the stoichiometric air-fuel ratio, and KCMDML represents a value corresponding to an air-fuel ratio of 22. FIGS. 6A to 6C collectively show an example of changes of the respective parameters taking place when the operating condition of the engine shifts from a state where the lean-burn control conditions are not satisfied to a state where the conditions are satisfied at the time point t1. When the lean-burn control conditions are satisfied, first the reduction enrichment is carried out from the time point t1 to the time point t2, and then the lean-burn control is started. At the time point t2, the counter CTRR is set to the second predetermined value CTRRINT2. The timer tmRR is set to a longer value as the engine rotational speed NE is higher at the steps S21 to S25, and the reduction enrichment desired equivalent ratio KCMDRR is set to a larger value as the engine rotational speed NE is higher and/or the intake pipe absolute pressure PBA is higher. Accordingly, the degree of enrichment is controlled to a larger value as the engine rotational speed NE is higher and/or the intake pipe absolute pressure PBA is higher. When the engine rotational speed NE is higher and/or the intake pipe absolute pressure PBA is higher, a flow rate of exhaust gases (volume/time) or a flow velocity of exhaust gases (volume/(time×cross sectional area)) increases, and therefore the degree of reduction enrichment is controlled to a larger value as the exhaust gas flow rate or exhaust gas flow velocity increases.

Therefore, when the engine operating condition is changed from a state where the air-fuel ratio is controlled to the stoichiometric air-fuel ratio or a richer value to a state where the lean-burn control is carried out, first the reduction enrichment is carried out, and then the lean-burn control is carried out. Besides, the degree of reduction enrichment is controlled to a larger value as the engine rotational speed NE is higher and/or the intake pipe absolute value PBA is higher. As a result, the reduction enrichment can be carried out in a manner suitable for operating conditions of the engine, to thereby maintain good exhaust emission characteristics without increasing the emission amounts of NOx, or HC and CO.

When the count value of the counter CTRR reaches the predetermined threshold value CTRRACT during execution of the lean-burn control at the time point t3 in FIG. 6, the timer tmRR is set to one of the predetermined values TMRRL, TMRRM, and TMRRH selected according to the engine rotational speed NE then assumed. At the same time, the reduction enrichment desired equivalent ratio KCMDRR is set according to the engine rotational speed NE and the intake pipe absolute pressure PBA then assumed, to thereby start the reduction enrichment. Thereafter, when the count value of the timer tmRR becomes equal to "0" at a time point t4 in FIG. 6, the reduction enrichment is terminated, and the counter CTRR is reset to the second predetermined value CTRRINT2. Thereafter, so long as the lean-burn control conditions are satisfied, the same operation carried out from the time point t2 to the time point t4 is repeatedly carried out after the time point t4.

In this manner, whenever the lean-burn control continues over a predetermined time period (TL1, TL2, TL3, . . . ) determined by the count value of the counter CTRR and the predetermined threshold value CTRRACT, the reduction enrichment is carried out, and the degree of the reduction enrichment is controlled to a larger value as the engine rotational speed NE is higher and/or the intake pipe absolute pressure PBA is higher. As a result, the reduction enrichment can be carried out in a manner suitable for operating conditions of the engine, to thereby maintain good exhaust emission characteristics without increasing the emission amounts of NOx, or HC and CO.

When the count value of the counter CTRR reaches the predetermined threshold value CTRRACT, it is determined that the lean-burn control has continued over the predetermined time period (TL1, TL2, TL3, . . . ). The increment CTSV of the count value of the counter CTRR is set to a larger value as the engine rotational speed NE is higher and/or the intake pipe absolute pressure PBA is higher. The larger the increment CTSV, the shorter the predetermined time period (TL1, TL2, TL3, . . . ) over which the lean-burn control is to continue. Thus, the duration or time ratio of execution of the reduction enrichment is increased with an increase in the flow rate of exhaust gases, to thereby carry out the reduction enrichment in a manner more suitable for operating conditions of the engine.

To facilitate understanding of the process of FIGS. 3 and 4, the timing chart of FIGS. 6A to 6C is depicted such that the time ratio of execution of the lean-burn control (=TL/(TR+TL)) is smaller than the actual time ratio, in other words, the time ratio of execution of the reduction enrichment (=TR/(TR+TL)) is larger than the actual time ratio. Since the increment CTSV of the count value of the counter CTRR varies according to operating conditions of the engine, the count value of the counter CTRR does not always linearly increase as indicated in FIG. 6C.

The present invention is not limited to the embodiment described above, but various modifications thereto are possible. For instance, although in the above described embodiment, to control the degree of reduction enrichment according to the flow rate of exhaust gases, all of the increment CTSV of the count value of the counter CTRR, the duration of execution of the reduction enrichment (the count value of the timer tmRR) and the set air-fuel ratio KCMDRR are changed, this is not limitative, but only one of the parameters may be changed. Alternatively, the duration of execution of the reduction enrichment may be set according to the engine rotational speed NE and/or the engine load. Further, the duration of execution of the reduction enrichment (the count value of the timer tmRR) may be determined based on load on the engine such as the intake pipe absolute pressure PBA together with or in place of the engine rotational speed NE.

What is claimed is:

1. An air-fuel ratio control system for controlling an air-fuel ratio of a mixture supplied to an internal combustion engine having an exhaust system, comprising:

an exhaust gas purifying-device arranged in said exhaust system and accommodating a nitrogen oxide absorbent for absorbing nitrogen oxides in exhaust gases emitted from said engine; and reduction means for reducing nitrogen oxides absorbed by said nitrogen oxide absorbent by enriching said air-fuel ratio of said mixture supplied to said engine;

wherein said reduction means sets a degree of said enriching of said air-fuel ratio of said mixture to a larger value as a flow rate or flow velocity of said exhaust gases increases.

2. An air-fuel ratio control system as claimed in claim 1, wherein said reduction means sets a desired air-fuel ratio to which said air-fuel ratio of said mixture is to be enriched by said enriching to a richer value as at least one of rotational speed of said engine and load on said engine is higher.

3. An air-fuel ratio control system as claimed in claim 1, wherein said reduction means sets a time period over which said enriching is to continue to a longer value as at least one of rotational speed of said engine and load on said engine is higher.

4. An air-fuel ratio control system as claimed in claim 2, wherein said reduction means sets a time period over which said enriching is to continue to a longer value as said at least one of rotational speed of said engine and load on said engine is higher.

5. An air-fuel ratio control system as claimed in claim 1, wherein said reduction means is operable when air-fuel ratio leaning control of leaning said air-fuel ratio of said mixture to a leaner value than a stoichiometric air-fuel ratio has continued over a predetermined time period.

6. An air-fuel ratio control system as claimed in claim 5, wherein said predetermined time period is set depending on operating conditions of said engine.

7. An air-fuel ratio control system as claimed in claim 6, wherein said predetermined time period is set to a shorter value as at least one of rotational speed of said engine or load on said engine is higher.

8. An air-fuel ratio control system as claimed in claimed 1, wherein said reduction means is operable immediately when said engine has shifted from an operating condition in which said air-fuel ratio of said mixture is controlled to a value equal to or richer than a stoichiometric air-fuel ratio to an operating condition in which said air-fuel ratio of said mixture is controlled to a value leaner than said stoichiometric air-fuel ratio.

* * * * *